US009969075B2

(12) United States Patent
Mitchell et al.

(10) Patent No.: US 9,969,075 B2
(45) Date of Patent: May 15, 2018

(54) HAND IMPLEMENT WITH SHOCK ABSORBER

(71) Applicant: 9301160 CANADA INC., Eastman (CA)

(72) Inventors: David R. Mitchell, Eastman (CA); Michael Moliner, Eastman (CA)

(73) Assignee: 9301160 CANADA INC., Eastman, QC (CA)

( * ) Notice: Subject to any disclaimer, the term of this patent is extended or adjusted under 35 U.S.C. 154(b) by 0 days. days.

(21) Appl. No.: 15/518,339

(22) PCT Filed: Sep. 21, 2015

(86) PCT No.: PCT/CA2015/050926
§ 371 (c)(1),
(2) Date: Apr. 11, 2017

(87) PCT Pub. No.: WO2016/058090
PCT Pub. Date: Apr. 21, 2016

(65) Prior Publication Data

US 2017/0312905 A1 Nov. 2, 2017

Related U.S. Application Data

(60) Provisional application No. 62/062,987, filed on Oct. 13, 2014.

(51) Int. Cl.
*B25G 1/01* (2006.01)
*E01H 5/02* (2006.01)

(52) U.S. Cl.
CPC ..... *B25G 1/01* (2013.01); *E01H 5/02* (2013.01)

(58) Field of Classification Search
CPC .. B25G 1/01; B25G 3/10; B25G 1/102; E01H 5/02; A01B 1/026
(Continued)

(56) References Cited

U.S. PATENT DOCUMENTS 541,841 A * 7/1895 Doyle
4,615,553 A * 10/1986 Hultine ..... A01B 1/22 16/426
(Continued)

FOREIGN PATENT DOCUMENTS

AU 9645895 1/1997
CA 2589429 11/2007
(Continued)

OTHER PUBLICATIONS

International Search Report issued in corresponding PCT application No. PCT/CA2015/050926, dated Dec. 15, 2015.

*Primary Examiner* — Paul T Chin
(74) *Attorney, Agent, or Firm* — Norton Rose Fulbright Canada LLP

(57) ABSTRACT

A lifting implement, such as a shovel has a handle and a load bearing member. The handle includes an articulated joint dividing the handle between a major portion and a lever portion. The lever is adapted to pivot within the range of an acute angle relative to the handle profile. The lever and the major portion of the handle each have a means for mounting a resilient member therebetween, where the resilient member is capable of absorbing shock and storing energy when urged by the pivoting of the lever within the range during the motion of lifting a load, and which stored energy is released when the load is being heaved by the implement. The handle may include a hand grip and a gripping portion on the major portion spaced from the articulated joint such that a triangle is formed with the hand grip, the gripping portion and the articulated joint at the apex of the triangle, wherein the apex of the triangle.

21 Claims, 9 Drawing Sheets

(58) Field of Classification Search
USPC ..... 294/49, 54.5, 57, 58, 59; 16/422, 426, 16/430
See application file for complete search history.

(56) References Cited

U.S. PATENT DOCUMENTS 4,663,995 A * 5/1987 Amundson ..... B25B 27/00 254/131.5
4,691,954 A 9/1987 Shaud
4,730,860 A * 3/1988 Padgett ..... A01B 1/02 294/49
D360,342 S * 7/1995 Shea ..... 294/49
5,533,768 A * 7/1996 Mitchell ..... B25G 1/01 294/54.5
5,727,829 A * 3/1998 Bellichak ..... A01B 1/02 15/111
5,816,634 A 10/1998 Jacobs et al.
6,792,829 B2 * 9/2004 Garcia ..... E04D 15/003 254/131.5
7,118,145 B1 * 10/2006 Rosine ..... B25G 1/01 294/57
7,559,591 B1 * 7/2009 DeSanti ..... E01H 5/02 294/49
7,581,771 B2 * 9/2009 Rosine ..... A01B 1/02 294/54.5
D618,973 S * 7/2010 Gosselin ..... D8/10
9,662,779 B1 * 5/2017 Yancey ..... B25G 1/102

FOREIGN PATENT DOCUMENTS

CA 2641020 4/2010
GB 2371513 3/2004
WO WO99/55135 11/1999

* cited by examiner

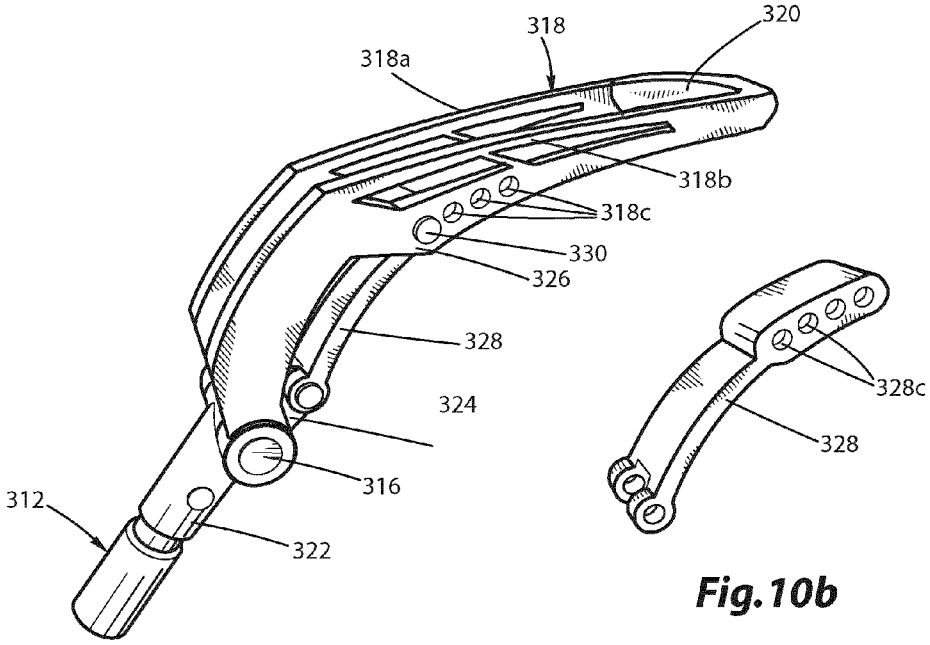
Fig.10b
Fig.10a
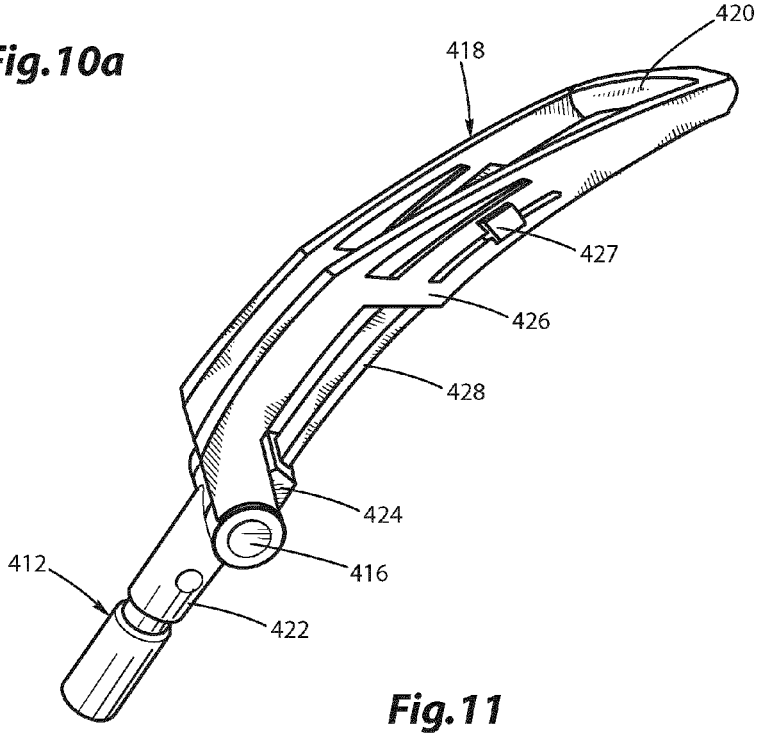
Fig.11

HAND IMPLEMENT WITH SHOCK ABSORBER

TECHNICAL FIELD

The present application relates to shock-absorbing implement handles and, more specifically, to handles for lifting implements such as shovels.

BACKGROUND ART

When a hand implement, such as a shovel, impacts against a dense substance such as ice or a rock, a shock may be imparted through the implement. Several devices have been identified which attempt to provide a cushion or shock absorber to the handle. For example U.S. Pat. No. 4,691,954 Shaud 1987; AU 9645895 Deliu 1997; U.S. Pat. No. 5,816,634 Jacobs et al; WO99/55135 Nicholl 1999 and GB2,371,513 Russell, all show handles with a linear compression device, usually a compression spring.

Although a linear compression device, in an implement handle, may act as a shock absorber in axial type loads, I have improved on such devices by integrating a deflection feature using a resilient component to the implement handle to absorb lifting loads. Such a shovel is illustrated in my patent Canadian application CA 2,641,020.

The devices shown and described in CA 2,641,020 add an articulated, resilient, leveraging feature, to the shovel handle, providing a force assisting boost allowing the user to heave the contents on the shovel much further, using the energy stored by the resilient device.

SUMMARY

Applicant has made further improvements as described herein.

In accordance with a general aspect, there is provided an elongated handle with a distal end and a proximal end. The handle having a handle profile and including an articulated joint at a minor distance from the proximal end dividing the handle between a major portion extending from the distal end to the joint, and, a lever portion extending from the joint to the proximal end. A first prehension zone provided at the proximal end of the lever and a second prehension zone on the major portion. The lever portion is adapted to pivot about the joint within the range of an acute angle relative to the handle profile, and the handle profile defines a triangle with the base extending between the first and second prehension zones and the joint forms the apex of the triangle. The lever and the major portion of the handle each mounting respective ends of a resilient member therebetween, wherein the resilient member is capable of storing energy when applied by the pivoting of the lever within the range during the motion of engaging a load characterized by the translation of the apex of the triangle with respect to the base causing the resilient member to absorb shock and store energy.

In a more specific embodiment, the lever includes a recessed seat adjacent the joint and a pair of brackets facing each other from the opposite ends of the seat wherein a first bracket is fixed to the lever while the second bracket is fixed to the major portion of the handle; and a resilient member fixed to and extending between the pair of brackets overlying the seat wherein the tool handles lend themselves to being stacked.

In another embodiment of the present invention the bracket in at least one of the lever and major portion of the handle is mobile while the resilient member is an elongated flexible member with one end portion engaged in the bracket that is mobile and the other end portion is engaged with the bracket in the other of the lever and major portion of the handle such that the length of the flexible member may be varied by adjusting the position of the at least one mobile bracket whereby the stiffness of the resilient member is adjusted.

In another aspect there is an energy storing device for a lifting implement including a handle and a load bearing portion wherein the energy storing device includes a an articulated joint to be mounted to a proximal end of the handle; and the device forming a lever extending from the joint to a first prehension zone provided at the proximal end of the lever and a second prehension zone on the handle; the lever adapted to pivot about the joint within the range of an acute angle relative to the handle. The handle and the lever defining a triangle with the base extending between the first and second prehension zones and the joint forming the apex of the triangle; the lever and the handle each mounting respective ends of a resilient member therebetween, the resilient member capable of storing energy when applied by the pivoting of the lever within the range during the motion of engaging a load characterized by the translation of the apex of the triangle with respect to the base causing the resilient member to absorb shock and store energy.

For clarity the following terms are explained in more detail:

"handle profile" means the longitudinal axis of the elongated handle, if it was straight but the approximation of a straight line including the joint when curved the handle is curved. Although a curved ergonomic handle is shown in the drawings, it is intended that a straight linear handle, at least for the major portion, be straight.

"lifting implement" means any shovel blade, fork for hay, blade for a spade, hand plow for scraping or the like.

"Lifting" for the purposes of this description includes any use that the implement is subjected to such as lifting and heaving a load such as snow or soil; scraping snow or ice; breaking or chipping ice or hard snow; digging in soft or hard soil.

BRIEF DESCRIPTION OF THE DRAWINGS

Reference is now made to the accompanying drawings in which:

FIG. 10*a* is a fragmentary, perspective view of a still further embodiment of the handle;

FIG. 10*b* is a fragmentary, side elevation of the handle shown in FIG. 10*a;*

FIG. 11 is a fragmentary, perspective view of yet another embodiment of the handle;

DETAILED DESCRIPTION

Referring to FIGS. 1 to 7 there is shown a lifting implement such as a snow shovel 10 having an elongated handle 12, a blade 14 at the distal end of the handle 12, and a grip 20 at the proximal end of the handle 12. The handle 12, as will be described may be used with any implement used for lifting or scraping. Examples in addition to snow shovels include round shovels, square shovels, spades, hand plows, hay forks, and the like.

Figure 2:
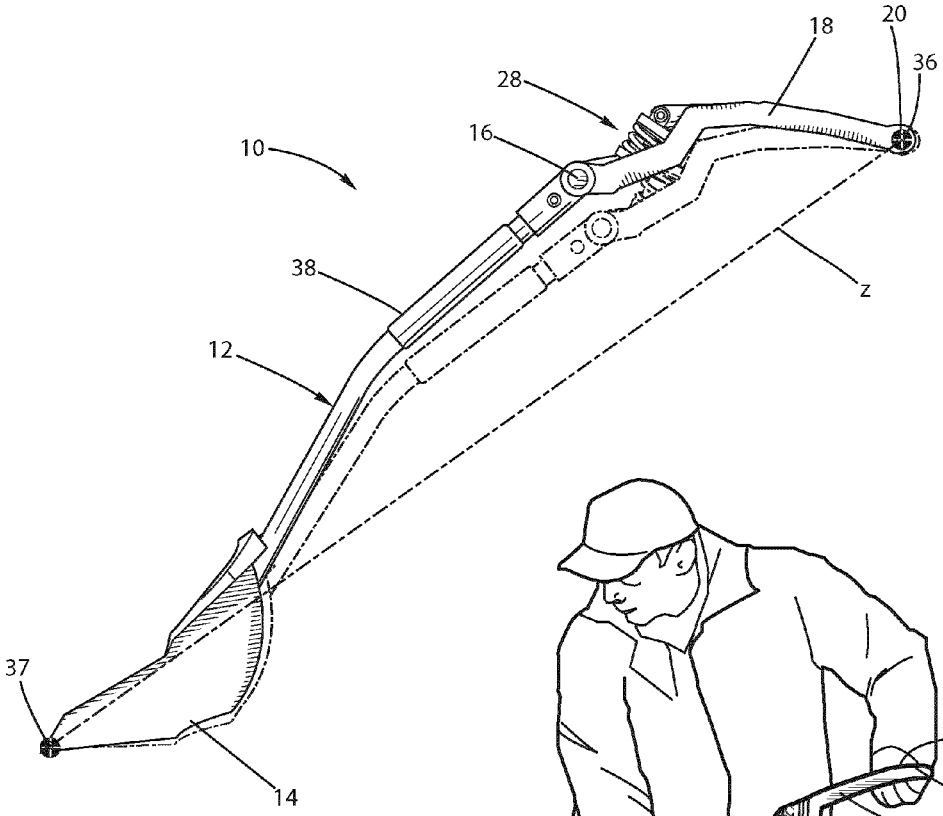
FIG. 2 is a side elevation view of the shovel shown in FIG. 1, with the handle shown in two positions at opposite limits of the range of operation.
Figure 1:
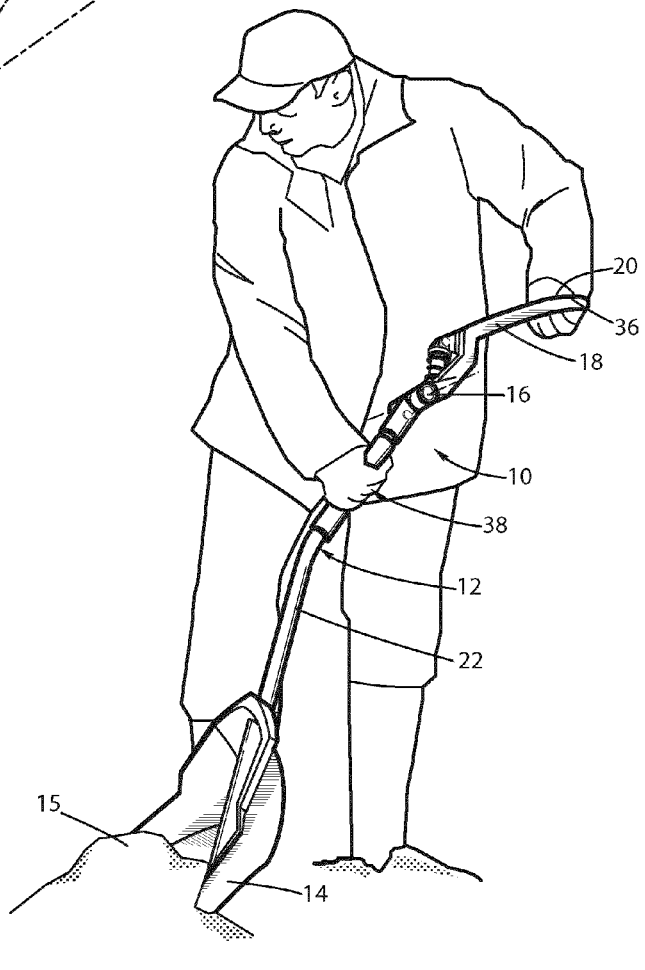
FIG. 1 is a perspective view of one embodiment of a shovel in accordance with an embodiment, held by a user.

As shown in FIGS. 1 and 2, the handle 12 is a so-called ergonomic handle which allows a user to stand more upright because the lower prehension zone 38 is higher due to the curvature of the handle profile. The handle 12 has the profile of an arc with an chord "z" extending from the proximal end or prehension zone 36 of the lever 18 to the contact tip 37 of the shovel blade 14. The joint 16 as well as the prehension zone 38 is spaced from the chord "z". In use this configuration allows any impact energy to be absorbed and converted into rotational energy. This is especially true when the implement is impacting a load or dense material as opposed to mere lifting.

Figure 3:
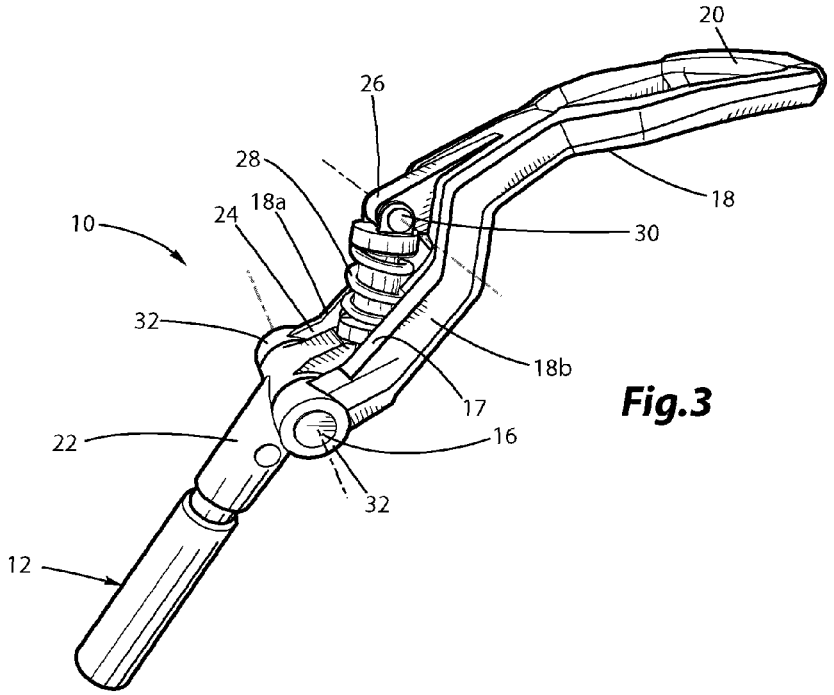
FIG. 3 is an fragmentary, perspective view showing a detail of the shovel shown in FIG. 1.
Figure 4:
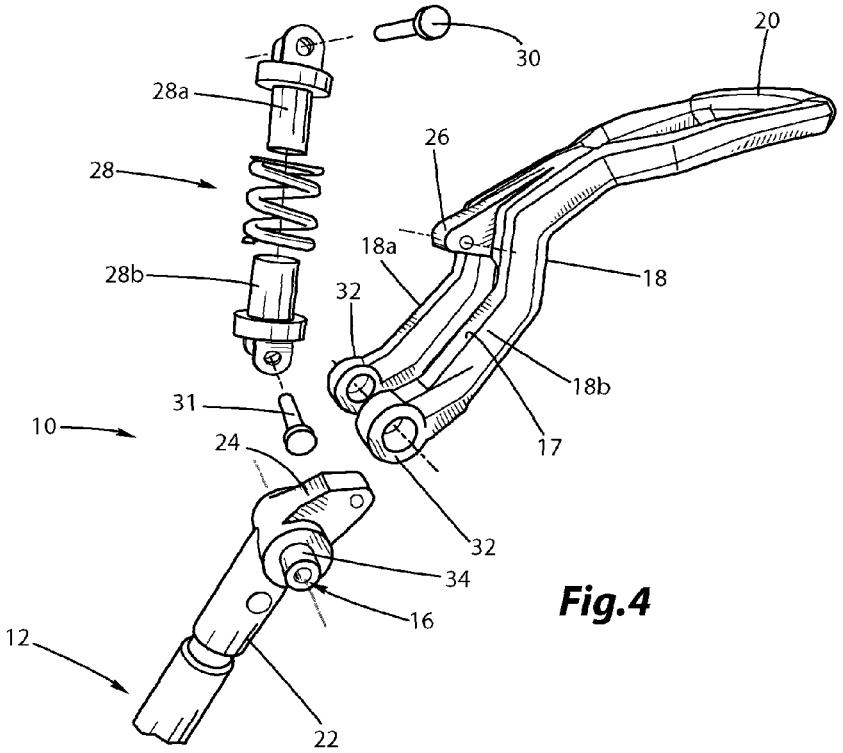
FIG. 4 is a fragmentary, perspective, exploded view of the detail shown in FIG. 3.

As shown in FIGS. 3 and 4, the handle 12 is separated by a joint 16. The joint 16 is located a minor distance from the grip 20 at the proximal end of the handle 12. The portion of the handle between the joint 16 and the grip 20 is identified as lever 18. The major portion 22 of the handle 12 extends between the distal end and the joint 16. The grip 20 represents a first prehension zone 36 and the second prehension zone is located at 38 on the major portion 22. The joint 16 is approximately midway between the first and second prehension zones 36 and 38.

The lever 18 is made up of bifurcated arms 18*a* and 18*b* forming a recessed seat 17. The bifurcated arms 18*a* and 18*b* define hinge barrels 32 at the free ends thereof and are adapted to engage bushings 34 mounted to the major portion 22 coincident with the joint 16. A bracket 24 projects from the distal end of the major portion 22 towards a position between the bifurcated arms 18*a* and 18*b* within the seat 17, beyond the axis of joint 16. A companion bracket 26 projects from the lever 18 over a portion of the seat 17.

A coiled spring assembly is best shown in FIG. 4. The spring assembly includes a pair of hinge brackets 28*a* and 28*b* extending from either end of a coil spring 28 and fixed to the respective ends thereof. Each of the hinge brackets 28*a* and 28*b* have stub shafts which act as stops as will be described further. The hinge bracket 28*a* is pivotally mounted to the bracket 26 on the lever 18 by means of a pin 30. The hinge bracket 28*b* is likewise pivotally mounted to the bracket 24 by means of a pin 31.

Figure 5:
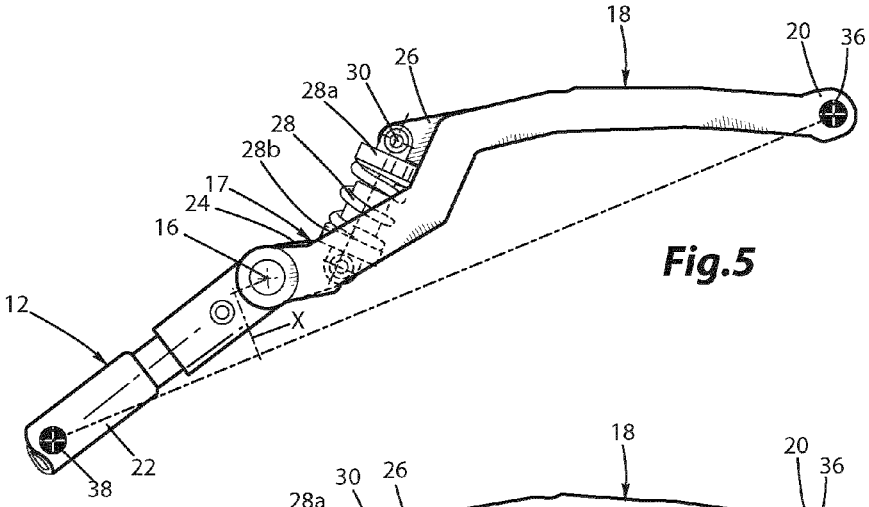
FIG. 5 is a side elevational view of the detail shown in FIG. 3.
Figure 6:
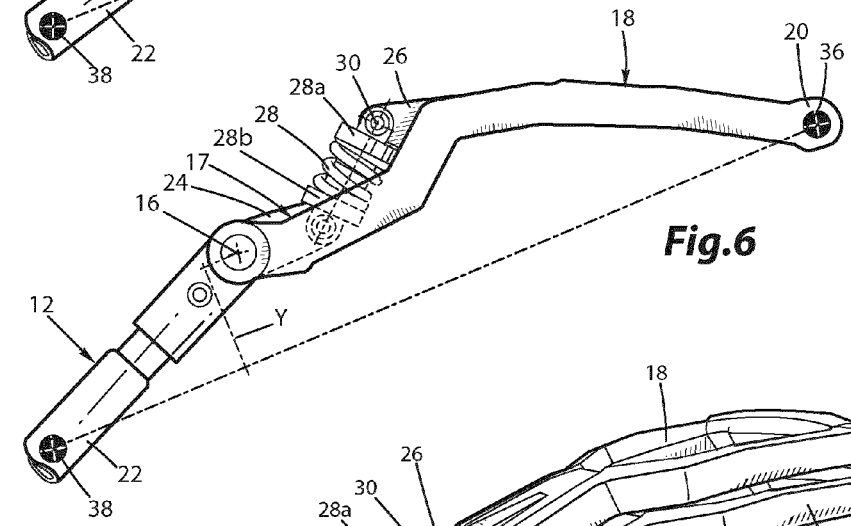
FIG. 6 is a side elevational view similar to FIG. 5 but showing the detail in a different operative position.

As can be seen, the shovel handle 12 thus includes a shock absorber that allows an angular deflection, during use, of the shovel 10. Referring to FIGS. 5 and 6, the displacement of the joint 16 can be seen in relation to the major portion 22 and the lever 18. FIG. 5 shows the handle 12 in a relaxed, neutral position. A triangle is defined that includes a base extending from a point at the first prehension zone 36, at the hand grip 20, to a point at the second prehension zone 38 on the major portion 22. The joint 16 is at the apex of the triangle. In a preferred embodiment, the triangle is an isosceles triangle. The distance between the center of the joint 16 and the base of the triangle, is shown as "x". Normally, a user would grip the shovel at prehension zone 36, with one hand, and the prehension zone 38 with the other hand. When the load 15 is engaged on the blade 14, as shown in FIG. 1, the other hand of the user, at prehension zone 38, will lift the major portion 22 causing the joint 16 to move counterclockwise about the fulcrum presented by the user's other hand at prehension zone 38; while the handle 12 is rotated in a clockwise rotation about the fulcrum presented by the user's one hand at prehension zone 36. The torque resulting from this translation movement of the joint 16 compresses the spring 28 as shown in FIG. 6. The compression of the spring 28 is limited by the stops on brackets 28*a* and 28*b* as previously described. The maximum translation of the joint 16 relative to the base of the triangle between the first and second prehension zones 36 and 38 is now a distance "y".

When using a lifting implement, such as a shovel 10 or hay fork (not shown), shock sometimes caused by striking a rock or ice will be absorbed by the resilient deflection of the translation of the joint 16. Likewise when displacing a load, such as snow or hay from one location to another by a "heaving" action, the implement 10, is a free lever operated by the user to enhance the heaving action by multiplying the forces resulting from the energy input provided by the user. In addition to acting as a shock absorber, when the spring 28 is compressed, the stored energy in the spring 28 is released when the load is "heaved" increasing the multiplication of force for the same energy input.

A shovel 10 would typically lift between 4.5 kg (10 lbs) and 23 kg (50 lbs), but more particularly 16 kg (35 lbs). In the present embodiment the spring was calibrated for a load of 14.5 kg (32 lbs). In this case the spring 28 would reach its maximum compression at 16 kg (35 lbs) with an angular deflection of 20°, displacing the joint 16 from "x" to "y". The lever 18 from the point on the prehension zone 36 (grip 20) to the joint 16 measures 36.80 cm (14.50"). The length of the major portion 22 will vary depending on the type of tool, but in the present embodiment the length was 86.36 cm (34"), the coil spring 28 had a spring index of 8.17; a length of 6.35 cm (2.5"); an internal diameter of 4.52 cm (1.78"); and a wire diameter of 0.55 cm (0.218").

It has been found that when the prehension zones 36 and 38 are at an initial angle from one another, as the joint 16 is translated through the work of the implement 10, the angle of the prehension zones 36 and 38 changes in direct proportion with level of deflection of the handle 12. The human brain registers this change of angle and sends appropriate signals to the body to "adapt" to the "imminent" change of load as the handle 12 progressively reaches its maximum deflection angle for a given load.

Figure 7:
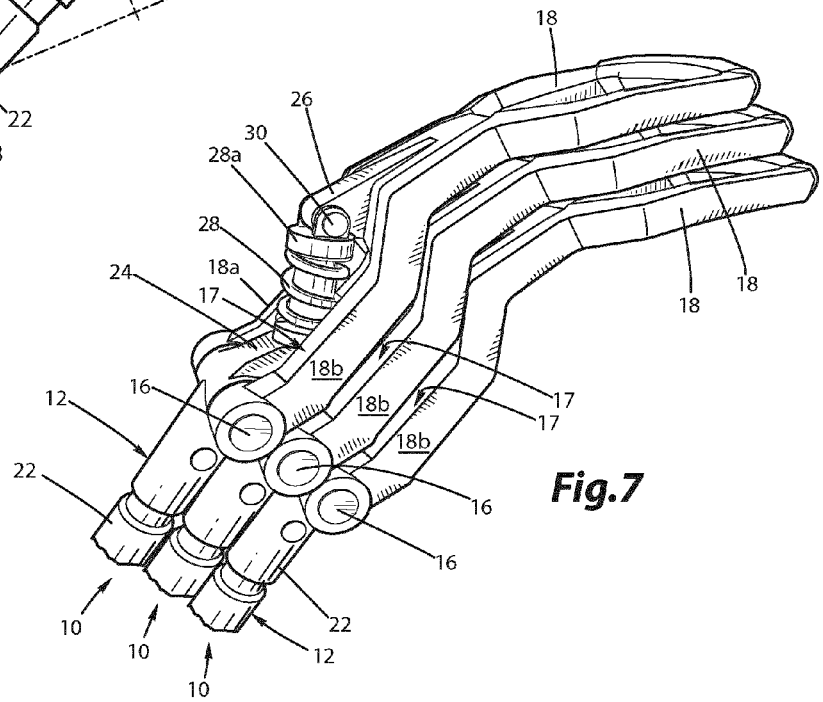
FIG. 7 is a fragmentary, perspective view of a cluster of shovels in accordance with the embodiment shown in FIG. 1, in a stacked position.

FIG. 7 shows three shovels 10 stacked for transport or storage. The particular configuration of the seat 17 and the position of the spring assembly 28 between the arms 18*a* and 18*b* allows the stackability of the shovels 10.

Figure 8:
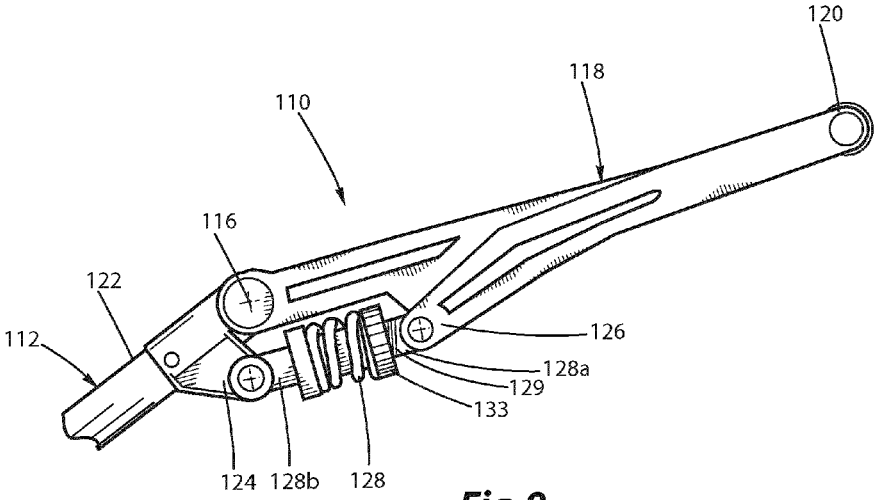
FIG. 8 is a fragmentary, side elevational view of another embodiment of the of the handle.

A second embodiment is shown in FIG. 8. In this embodiment similar reference numbers have been used but raised by 100. The bracket 126 extends behind the joint 116. The spring assembly 128 extends between the bracket 126 and bracket 124 which is fixed to the major portion 122. The hinge brackets 128*a* mounts a threaded disk 133 that can be translated by means of threads 129 on bracket 128*a* for adjusting the pitch of coil spring 128 and therefore the pre-compression thereof.

Figure 9A:
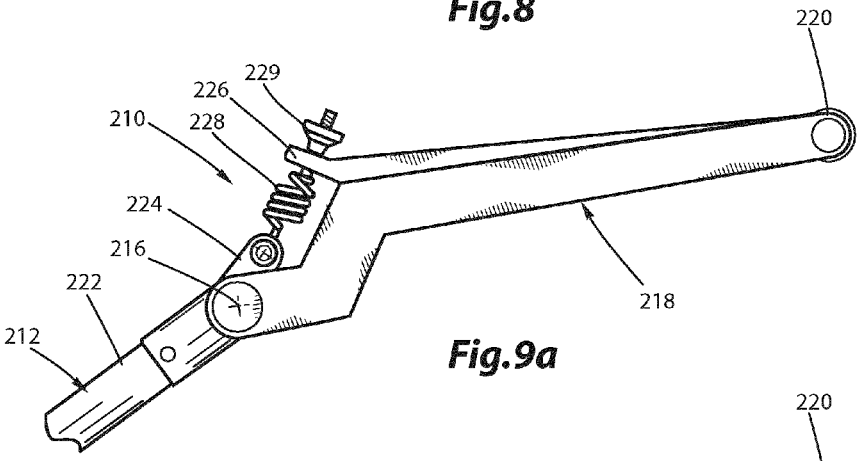
FIG. 9*a* is a fragmentary, side elevational view of yet another embodiment of the of the handle.
Figure 9B:
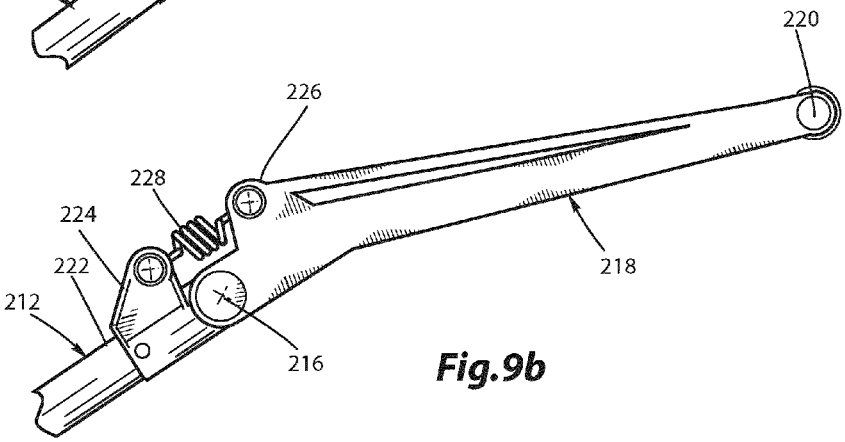
FIG. 9*b* is a fragmentary, side elevational view of still another embodiment of the handle.

FIGS. 9*a* and 9*b* illustrate two variants of a third embodiment where similar references have been increased by 200. In this embodiment, the spring 228 extends between the respective brackets 224, 226 on the front side of the handle 212 but offset of the profile of the handle. In FIG. 9*a*, an adjustment screw 229 is provided on the bracket 226 to adjust the pitch of the spring 228. The spring stores energy in tension as it is being extended.

The embodiment in FIGS. 10*a* and 10*b* shows the coil spring replaced by a resilient semi-rigid plastic bar 328 pivoted to the brackets 324 and 326. Arm 318*a* and 318*b* can be provided with a series of bores 318*c* to form pivot barrels to accommodate the adjustment of the length of the plastic bar 328. Corresponding bores 328*c* on the bar 328 match the bores 318*c*. When assembled the pin 330 may be selectively located in any pair of bores 318*c*, 328*c* in order to accommodate different pretension settings. The energy in this embodiment is stored by the deformation of the bar 328.

The embodiment in FIG. 11 utilizes a springboard 428 that is fixed at one end to the brackets 424 and extends in a slot provided in the bracket 426. A clamp 427 is adjustable on the bracket 426 in order to determine the effective length of the springboard 428 in order to select the pretension setting. Although the springboard 428 will not act in compression, it will store energy when deflected as in the embodiment of FIG. 10.

From the embodiments shown in FIGS. 10*a*-11, it will be evident to the person skilled in the art that the tool handles may also be stackable.

FIGS. 12 to 16*b*, shows embodiments that are conceptually similar to the embodiment shown in FIG. 11. The energy is stored by the degree of deflection of a flexible blade 528. The blade 528 is preferably made of spring steel but may be of another material with similar characteristics. In one example a spring steel section of 3.175 mm (0.125 in.) in thickness by 19.05 mm (0.750 in.) large by 203 mm (8 in.) in length.

FIGS. 12 to 15*b* illustrate an embodiment that includes a handle 512, with a grip 520 and arms 518*a* and 518*b*. A major portion 522 of the handle 512 pivots relative to the lever 518 at the joint 516. The major portion 522 including the extension 522*a*, is hollow as shown in FIGS. 13 to 15*b*. The bracket 524 is mobile and can slide within the hollow major portion 522. The bracket 524 includes an elongated rack 544 having gear teeth 544*a*.

Figure 13:
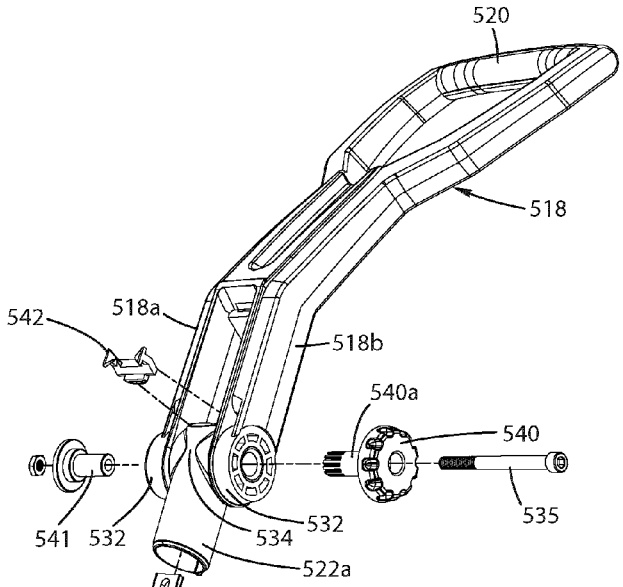
FIG. 13 is a fragmentary, exploded, perspective view of the handle according to FIG. 12*a:*
Figure 14:
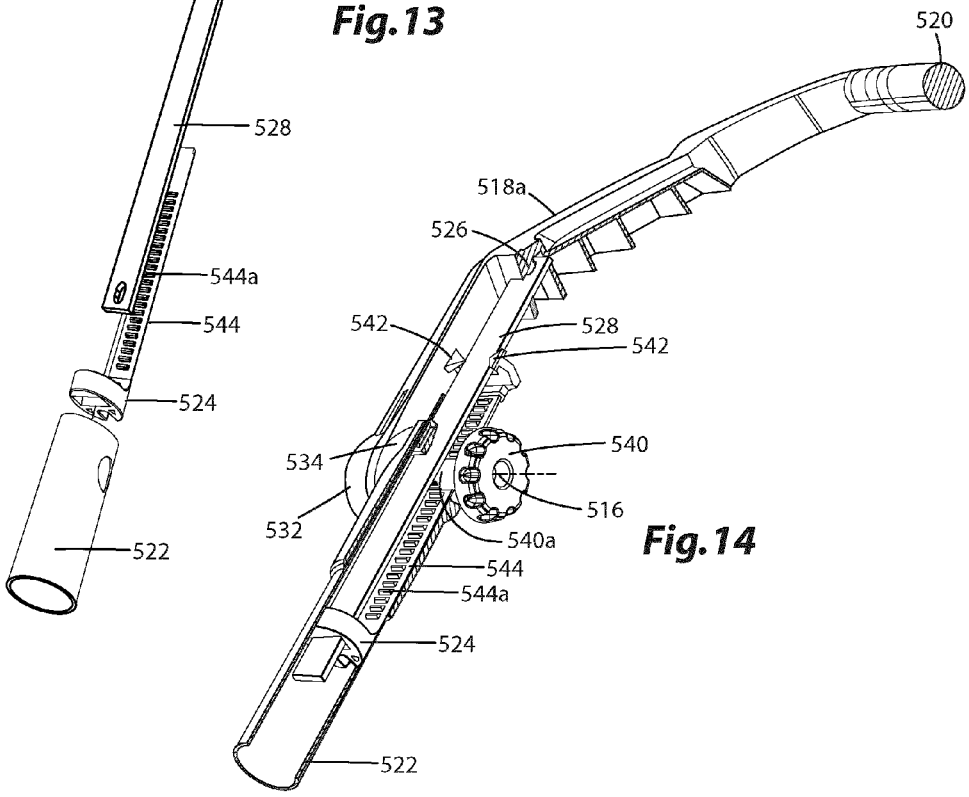
FIG. 14 is a fragmentary, perspective view, partly in cross-section, of the handle according to FIG. 12*a;*

The joint 516 includes a pair of barrels 532 formed on the ends of arms 518*a* and 518*b*, to accommodate bushings 534 on the major portion extension 522*a*. A pivot pin 535 extends through the axis of joint 516. Knob 540 is journalled on pivot pin 535. The knob assembly includes a flanged sleeve 541 journalled on the pivot pin 535. The knob 540 includes a sleeve with geared teeth 540*a*, as shown in FIG. 13.

Figure 12A:
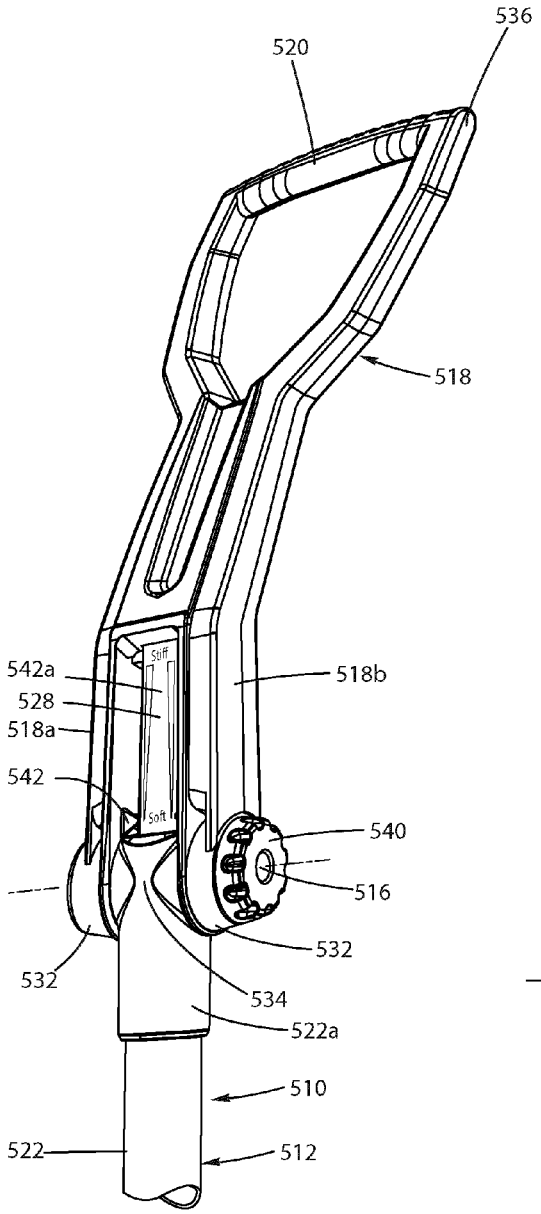
FIG. 12*a* is a fragmentary, perspective view of a quite different embodiment of the handle.
Figure 12B:
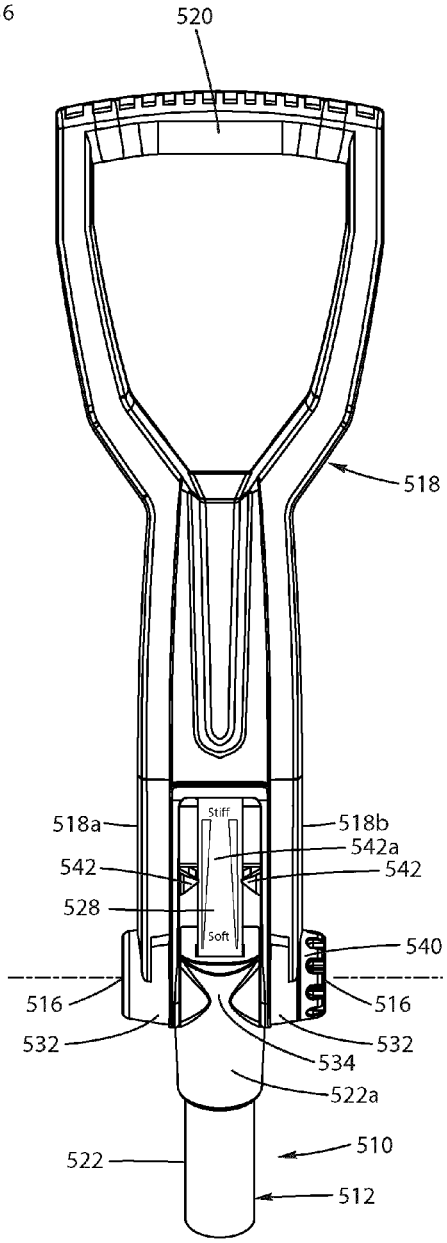
FIG. 12*b* is a fragmentary, top view of the handle in accordance with the embodiment shown in FIG. 12*a;*
Figures 15A, 15B:
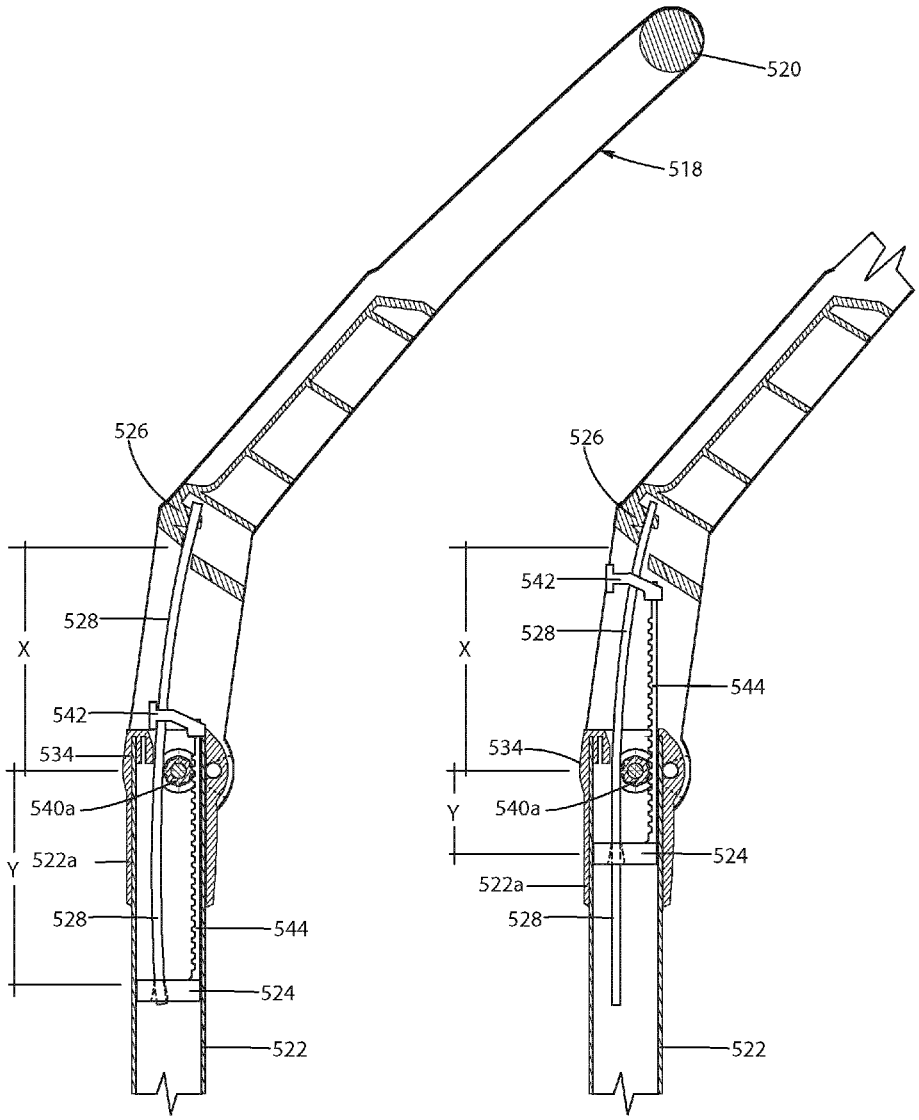
FIG. 15*a* is a fragmentary, axial cross-section of the handle according to the embodiment of FIG. 12*a;*
FIG. 15*b* is a fragmentary, axial cross-section of the handle according to the embodiment of FIG. 15*a;*

As shown in FIGS. 15*a* and 15*b*, the flexible blade 528 is slidable in bracket 524 but is fixed, at the other end, to the bracket 526 within the handle 518. By rotating the knob 540, the geared sleeve 540*a* will engage the rack 544 to advance the bracket 524 along the flexible blade 528 effectively reducing the active length "y" of the flexible blade 528. Likewise the mobile arrow 542 mounted to the end of the rack 544 and exposed on the top of the handle 518, as shown in FIGS. 12*a* and 12*b*, will display the stiffness of the flexible blade 528 either as "soft", as shown in FIG. 15*a*, or as "stiff", as shown in FIG. 15*b*.

Figures 16A, 16B:
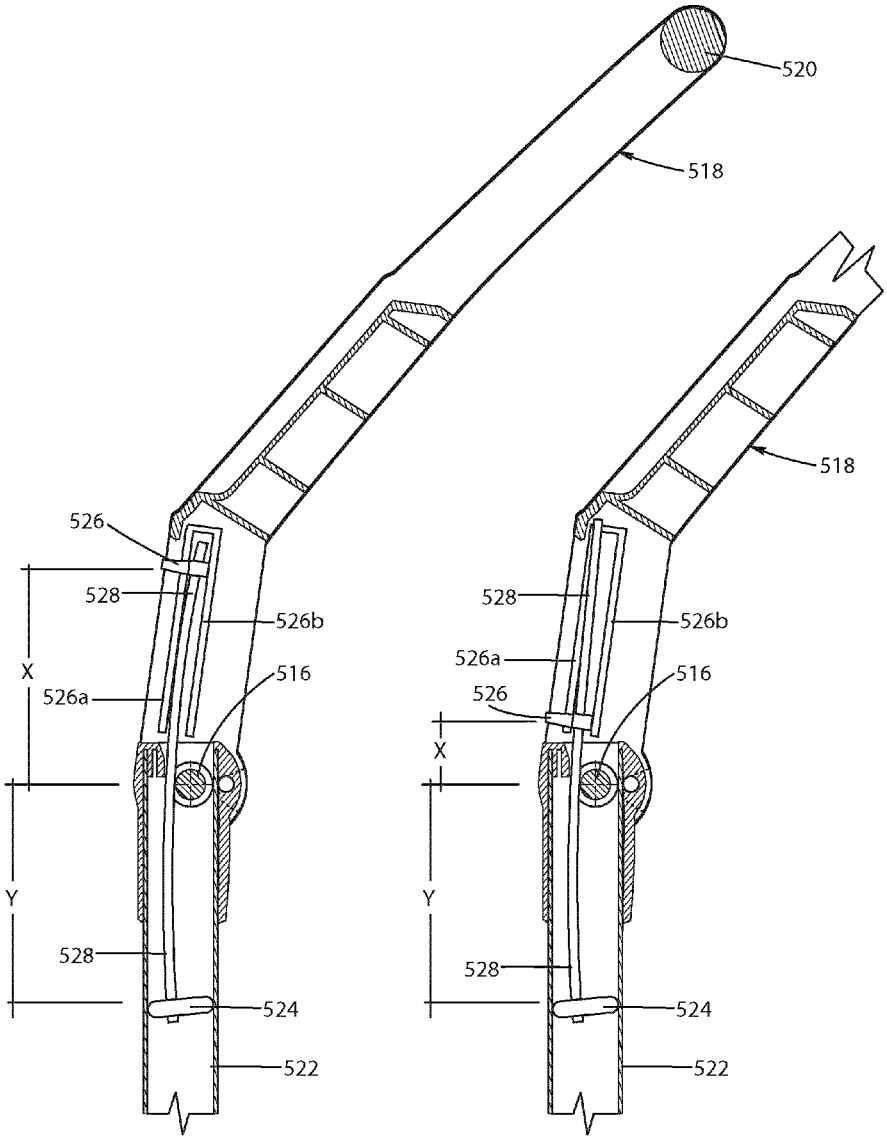
FIG. 16*a* is a is a fragmentary, axial cross-section of the handle according to a variant of the embodiment of FIG. 12*a*.
FIG. 16*b* is a fragmentary, axial cross-section of the handle according to the embodiment of FIG. 16*a.*

FIGS. 16*a* and 16*b* show a variant of the embodiment in FIGS. 15*a* and 15*b*. In this variant, bracket 524 is fixed within the hollow major portion 522. On the other hand the bracket 526 within the handle 518 is movable along tracks 526*a* and 526*b*. The bracket 526 protrudes through the handle 518 and may be engaged manually to adjust the effective length of the flexible blade 528, and thus the stiffness. In this case the distance "y" remains constant while the distance "x" is variable. According to this variant the position of the bracket 526 shown in FIG. 16*a* represents the soft condition of the flexible blade 528 while FIG. 16*b* illustrates the stiffer condition of the blade 528.

The above description is meant to be exemplary only, and one skilled in the art will recognize that changes may be made to the embodiments described without departing from the scope of the invention disclosed. Any modifications which fall within the scope of the present invention will be apparent to those skilled in the art, in light of a review of this disclosure, and such modifications are intended to fall within the appended claims.

The invention claimed is:

1. An elongated handle for a lifting instrument including a load bearing member, the handle having a distal end and a proximal end, the distal end being configured for connection to the load bearing member; the handle having a handle profile and including an articulated joint at a minor distance from the proximal end, the articulated joint dividing the handle between a major portion extending from the distal end to the articulated joint, and a lever portion extending from the articulated joint to the proximal end; a first prehension zone provided at the proximal end of the lever portion and a second prehension zone on the major portion; the lever portion being pivotable about the articulated joint within the range of an acute angle relative to the handle profile, the handle profile defining a triangle with a base of the triangle extending between the first and second prehension zones and the articulated joint forming an apex of the triangle; the lever portion and the major portion of the handle each mounting respective ends of a resilient member extending therebetween, the resilient member storing energy when applied by the pivoting of the lever portion within the range due to a load transferred to the handle characterized by the translation of the apex of the triangle with respect to the base causing the resilient member to absorb shock and store energy.

2. The elongated handle as defined in claim 1, wherein the handle includes a hand grip at the first prehension zone and a gripping portion at the second prehension zone, and wherein the triangle is an isosceles triangle, whereby the apex of the triangle is translated during a load transferred to the handle.

3. The elongated handle as defined in claim 1, wherein the resilient member is a coiled spring.

4. The elongated handle as defined in claim 3, wherein the coiled spring stores the energy in compression.

5. The elongated handle as defined in claim 3, wherein the coiled spring stores the energy in tension.

6. The elongated handle as defined in claim 1, wherein the range is between 0° and 20°.

7. The elongated handle as defined in claim 1, wherein the lever portion includes a recessed seat adjacent the articulated joint, wherein first and second brackets are located at the seat, the first bracket being provided to the lever portion while the second bracket is provided to the major portion of the handle; and wherein the resilient member is fixed to and extends between the first and second brackets, overlying the seat.

8. The elongated handle as defined in claim 1, wherein the resilient member is an elongated flexible member.

9. The elongated handle as defined in claim 8, wherein the elongated flexible member is a spring blade.

10. The elongated handle as defined in claim 9, wherein the spring blade is made of spring steel.

11. The elongated handle as defined in claim 1, wherein the lever portion and the major portion of the handle each include a bracket for mounting the resilient member therebetween, the resilient member storing energy when urged by the pivoting of the lever within the range during the motion of lifting a load.

12. The elongated as defined in claim 1, wherein the resilient member is adjustable to provide different degrees of stiffness to the handle.

13. The elongated handle as defined in claim 1, wherein the resilient member is adjustable to provide different degrees of stiffness to the handle, and wherein the resilient member is an elongated flexible member held between a pair of brackets one on the lever portion and the other on the major portion, whereby one of the brackets may be moved relative to the other to vary the length of the elongated flexible member to thereby adjust the degree of stiffness of the resilient member.

14. The elongated handle as defined in claim 13 wherein the elongated flexible member is a spring blade and one end of the blade is fixed to a movable bracket of the brackets, the movable bracket being movably engaged to one of the lever portion and the major portion.

15. The lifting implement as defined in claim 14, wherein the movable bracket is mounted for movement to the major portion and the other bracket is fixed to the lever portion and is in the form of a geared wheel journalled to the axis of the joint and forming part of the lever portion, the geared wheel engaging a geared rack fixed to the movable bracket such that when the geared wheel is rotated, it moves the movable bracket and the blade relative to the other bracket thereby adjusting the stiffness of the blade.

16. The elongated handle as defined in claim 14 wherein each of the brackets is movable, one on the major portion and the other on the lever portion; a track is fixedly mounted to one of the major portion and the lever portion so that one or the other of the brackets may be selectively engaged thereby; the spring blade being restrained from axial movement while the bracket selectively engaged on the track can determine the length of the spring blade between the brackets thus determining the stiffness of the spring blade.

17. The lifting implement as defined in claim 14, wherein the spring blade is a spring steel blade.

18. A lifting implement including an elongated handle with a distal end and a proximal end and a load bearing member at the distal end; the handle having a handle profile and including an articulated joint at a minor distance from the proximal end dividing the handle between a major portion extending from the distal end to the joint, and a lever portion extending from the joint to the proximal end; a first prehension zone provided at the proximal end of the lever portion and a second prehension zone on the major portion; the lever portion adapted to pivot about the joint within the range of an acute angle relative to the handle profile, the handle profile defining a triangle with a base of the triangle extending between the first and second prehension zones and the joint forming an apex of the triangle; the lever portion and the major portion of the handle each mounting respective ends of a resilient member therebetween, the resilient member storing energy when applied by the pivoting of the lever within the range during the motion of engaging a load characterized by the translation of the apex of the triangle with respect to the base causing the resilient member to absorb shock and store energy.

19. The lifting implement as defined in claim 18, wherein the handle includes a hand grip at the first prehension zone and a gripping portion at the second prehension zone and the triangle is an isosceles triangle, whereby the apex of the triangle is translated during a lifting and heaving motion of the lifting implement.

20. The lifting implement as defined in claim 18, wherein the handle profile is that of an arc with a chord extending from the proximal end to the tip of the implement at the distal end of the handle and the articulated joint is spaced from the chord.

21. An energy storing device for a lifting implement including a handle and a load bearing portion wherein the energy storing device includes an articulated joint to be mounted to a proximal end of the handle; the device forming a lever extending from the joint to a first prehension zone provided at the proximal end of the lever and a second prehension zone on the handle; the lever being pivotable about the joint within the range of an acute angle relative to the handle; the handle and the lever defining a triangle with a base of the triangle extending between the first and second prehension zones and the joint forming the apex of the triangle; the lever and the handle each mounting respective ends of a resilient member therebetween, the resilient member storing energy when applied by the pivoting of the lever within the range during the motion of engaging a load characterized by the translation of the apex of the triangle with respect to the base causing the resilient member to absorb shock and store energy.

* * * * *